US012569034B1

(12) United States Patent
Black

(10) Patent No.: US 12,569,034 B1
(45) Date of Patent: Mar. 10, 2026

(54) EXPANDABLE SHOE

(71) Applicant: Dorothy Black, Chicago, IL (US)

(72) Inventor: Dorothy Black, Chicago, IL (US)

( * ) Notice: Subject to any disclaimer, the term of this patent is extended or adjusted under 35 U.S.C. 154(b) by 0 days.

(21) Appl. No.: 19/091,134

(22) Filed: Mar. 26, 2025

(51) Int. Cl.
*A43B 3/24* (2006.01)
*A43B 13/36* (2006.01)
*A43C 11/12* (2006.01)

(52) U.S. Cl.
CPC ..... *A43B 13/36* (2013.01); *A43B 3/24* (2013.01); *A43B 3/242* (2013.01); *A43B 3/244* (2013.01); *A43B 3/248* (2013.01); *A43C 11/12* (2013.01)

(58) Field of Classification Search
CPC ..... A43B 13/36; A43B 3/24; A43B 3/242; A43B 3/244; A43B 3/246; A43B 3/248
USPC ..... 36/100, 101, 15
See application file for complete search history.

(56) References Cited

U.S. PATENT DOCUMENTS 2,493,154 A 1/1950 Mavrakis
2,839,845 A * 6/1958 Burton, Jr. ..... A43C 15/02 36/7.7
4,103,440 A * 8/1978 Lawrence ..... A43C 11/12 36/101
6,874,256 B2 4/2005 Delgatty
7,614,165 B2 11/2009 Curry
D802,261 S 11/2017 Strillwagon
10,827,800 B2 11/2020 Iannuzzi
2004/0231197 A1* 11/2004 Yama ..... A43B 13/36 36/15
2005/0229435 A1* 10/2005 Shih ..... A43B 3/24 36/15
2008/0072451 A1* 3/2008 Mizrahi ..... A43B 1/0045 36/2.6
2008/0072453 A1* 3/2008 Mizrahi ..... A43B 3/24 36/44
2008/0235992 A1* 10/2008 Stefani ..... A43B 3/24 36/43
2011/0283564 A1 11/2011 Stillwagon
2012/0324656 A1* 12/2012 Shu ..... A43B 3/244 12/146 B
2013/0086813 A1* 4/2013 Sen ..... A43B 3/10 36/42
2014/0013622 A1* 1/2014 Borroto ..... A43B 3/244 36/100
2015/0000160 A1* 1/2015 Giraldo ..... A43B 3/242 36/45
2015/0230540 A1* 8/2015 Harris ..... A43B 7/06 36/3 A (Continued)

FOREIGN PATENT DOCUMENTS

WO WO2016180567 11/2016

*Primary Examiner* — Marie D Bays

(57) ABSTRACT

An expandable shoe for expanding to adapt to growing feet includes an outsole, an upper, and an expansion strip. The expansion strip is coupled to a bottom edge of the upper. The upper may be joined to the outsole at the bottom edge of the upper to accommodate a foot of a first size between the upper and the outsole. The expansion strip may be joined to the outsole at a distal edge of the expansion strip with respect to the upper to accommodate a foot of a second size which is larger than the first size. In particular, the expansion strip spaces the upper farther upwardly away from the outsole to accommodate thicker feet. The expandable shoe could be used by a user with growing feet so that the expandable shoe adapts to one of the user's feet as it becomes thicker.

9 Claims, 4 Drawing Sheets

(56) References Cited

U.S. PATENT DOCUMENTS

| | | | | |
|---|---|---|---|---|
| 2018/0168275 | A1 | 6/2018 | Kaiser | |
| 2018/0242681 | A1* | 8/2018 | Lovett | A43B 3/242 |
| 2018/0242686 | A1* | 8/2018 | Pilto | A43B 3/244 |
| 2019/0239593 | A1* | 8/2019 | Willis | A43B 3/242 |
| 2025/0017311 | A1* | 1/2025 | Soin | A43B 13/36 |

* cited by examiner

EXPANDABLE SHOE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shoes and more particularly pertains to a new shoe for expanding to adapt to growing feet.

(2) Description of Related Art Including Information Disclosed Under 37 CFR 1.97 and 1.98

The prior art discloses various shoes which have removable uppers or other removable components such that the multiple components may be used which differ in appearance or shape from each other while retaining the same outsole. However, the prior art fails to disclose a shoe in which an expansion strip is attached to the bottom of the upper, and the upper may be joined to an outsole either directly or via the expansion strip to allow for feet of different thicknesses to wear the shoe.

BRIEF SUMMARY OF THE INVENTION

An embodiment of the disclosure meets the needs presented above by generally comprising an outsole, an upper, and an expansion strip. The upper is removably couplable to a top side of the outsole at a bottom edge of the upper. The expansion strip is coupled to the bottom edge of the upper and is removably couplable to the top side of the outsole at a distal edge of the expansion strip with respect to the upper. A connector assembly is provided which is usable to alternately attach the upper and the expansion strip to the outsole. The connector assembly comprises an outsole mating member mounted to the outsole, an upper mating member mounted to the upper, and an expansion strip mating member mounted to the expansion strip. The upper mating member is releasably couplable to the outsole mating member, and the expansion strip mating member is releasably couplable to the outsole mating member. The expansion strip may be folded or wadded and stored within a space formed between the upper and the outsole when the upper mating member is coupled to the outsole mating member.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
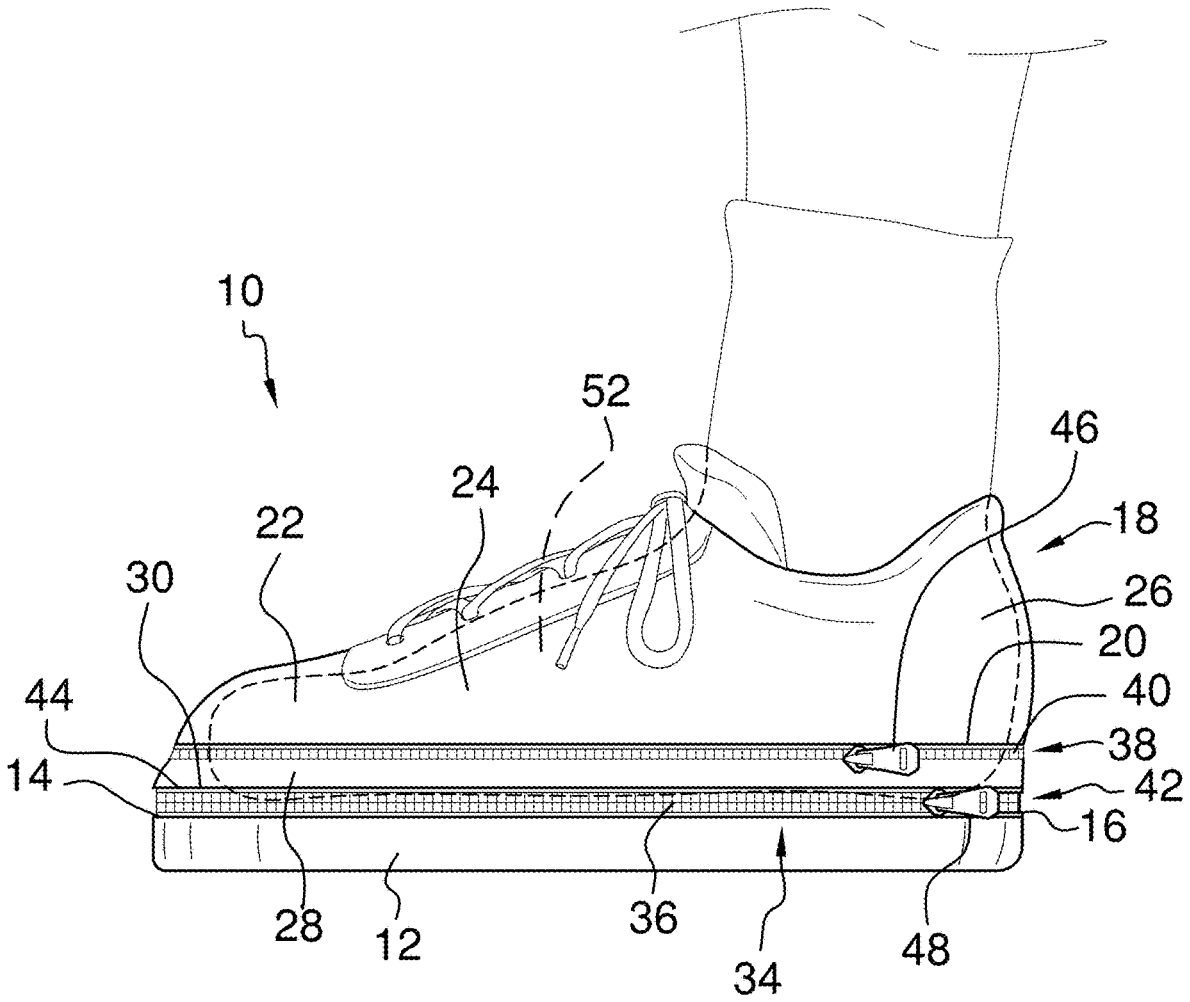
FIG. 1 is a side in-use view of an expandable shoe according to an embodiment of the disclosure. An expansion strip spaces an upper of the expandable shoe away from an outsole of the expandable shoe such that a space between the upper and the outsole is expanded versus the upper being directly joined to the outsole as in FIG. 4.
Figure 2:
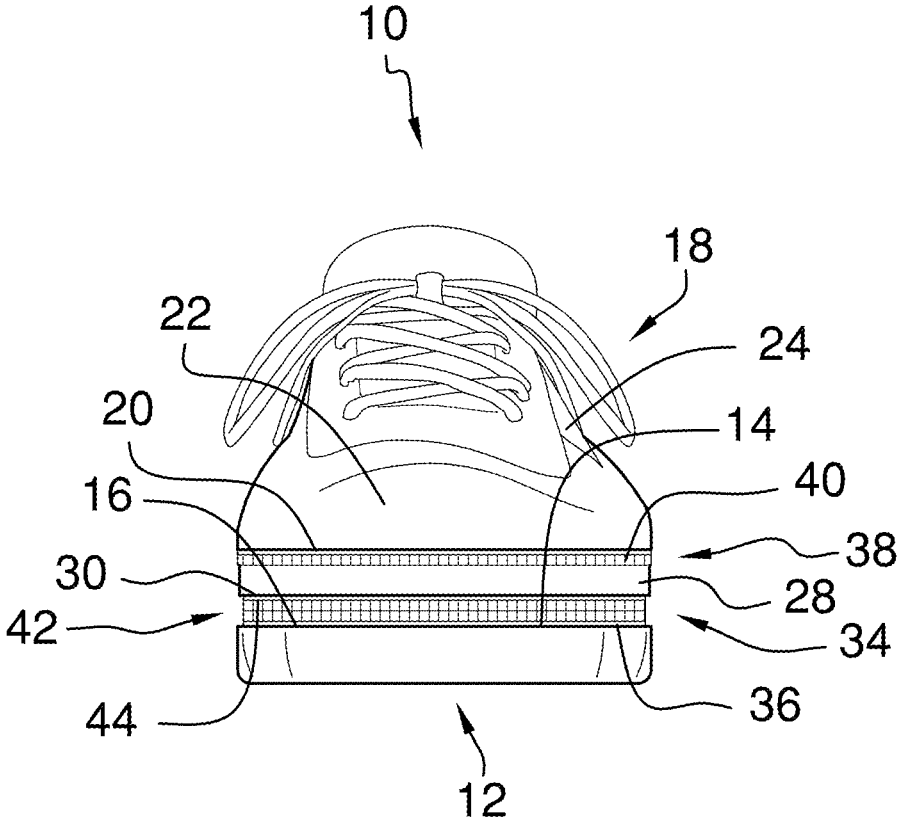
FIG. 2 is a front view of an embodiment of the disclosure.
Figure 3:
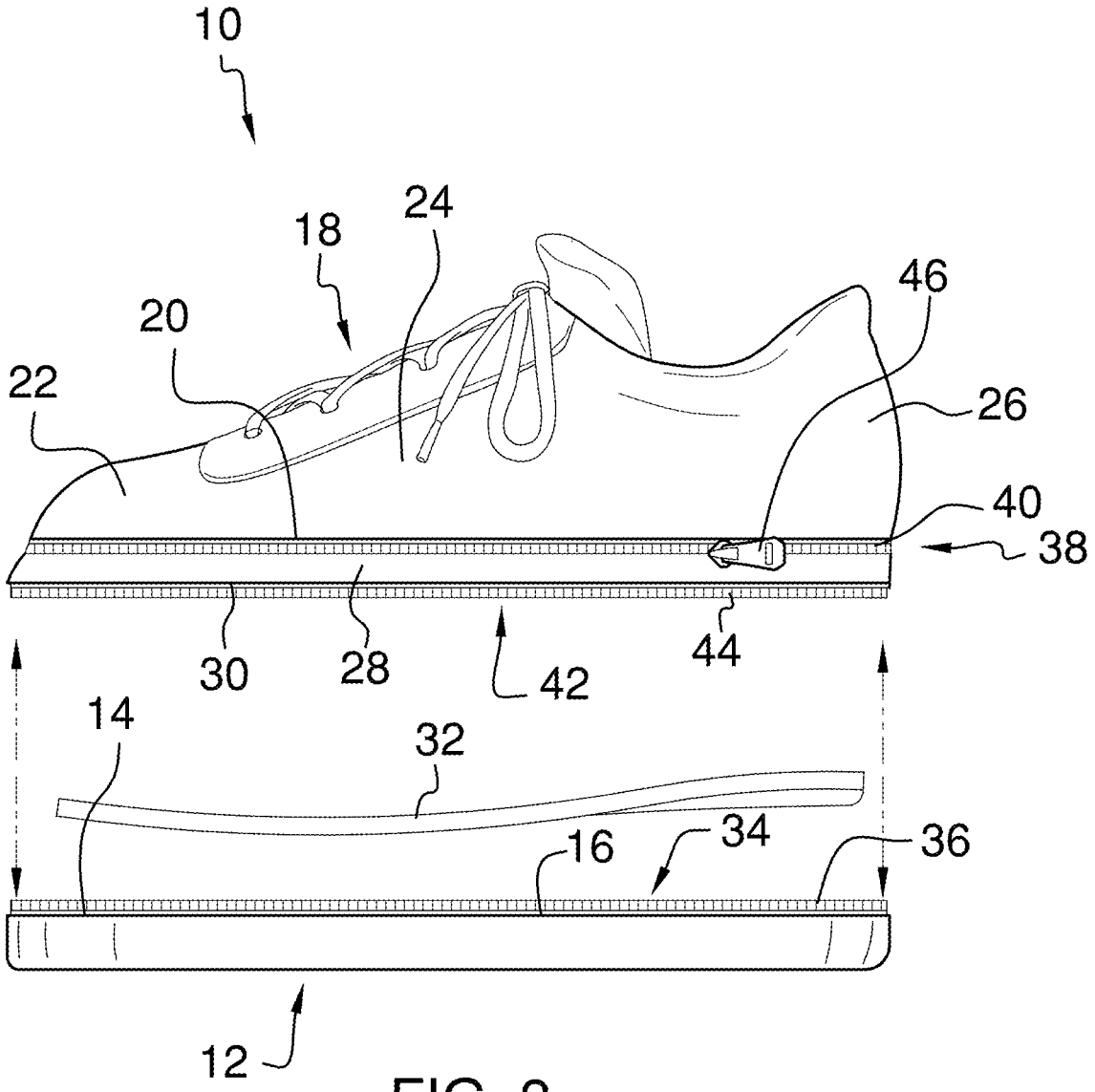
FIG. 3 is a side exploded view of an embodiment of the disclosure.

With reference now to the drawings, and in particular to FIGS. 1 through 4 thereof, a new shoe embodying the principles and concepts of an embodiment of the disclosure and generally designated by the reference numeral 10 will be described.

As best illustrated in FIGS. 1 through 4, the expandable shoe 10 generally comprises an outsole 12 which comprises a resilient material which may resiliently bend, twist, or otherwise deform while supporting a user wearing the expandable shoe 10. The resilient material may be rubber, silicone, or the like. An upper 18 is removably couplable to a top side 14 of the outsole 12 at a bottom edge 20 of the upper 18. The upper 18 comprises a toe box 22, a vamp 24, and a heel portion 26, wherein the vamp 24 is coupled to and extends between the toe box 22 and the heel portion 26. The bottom edge 20 of the upper 18 forms a closed loop.

An expansion strip 28 is coupled to the bottom edge 20 of the upper 18. The expansion strip 28 extends along an entirety of the bottom edge 20 of the upper 18. The expansion strip 28 is removably couplable to the top side 14 of the outsole 12 at a distal edge 30 of the expansion strip 28 with respect to the upper 18. The distal edge 30 of the expansion strip 28 also forms a closed loop. The upper 18 and the expansion strip 28 are integrally formed with each other and comprise a fabric material such as canvas or the like. The fabric material may be water-impermeable. In other embodiments, the expansion strip 28 may be separately formed from the upper 18 and may comprise a different material to that of the upper 18. An insole 32 may be provided and positioned between the upper 18 and the outsole 12 when the outsole 12 is coupled to the upper 18 or the expansion strip 28. The insole 32 may comprise a cushioning material such as a rubber foam or the like.

A connector assembly is provided which is usable to alternately attach the upper 18 and the expansion strip 28 to the outsole 12. The connector assembly comprises an outsole mating member 34 mounted to the outsole 12, an upper mating member 38 mounted to the upper 18, and an expansion strip mating member 42 mounted to the expansion strip 28. The outsole mating member 34 is alternately couplable to the upper mating member 38 and the expansion strip mating member 42.

The outsole mating member 34 comprises an outsole zipper chain 36 which extends along an entirety of a peripheral edge 16 of the top side 14 of the outsole 12. The upper mating member 38 comprises an upper zipper chain 40 which extends along the entirety of the bottom edge 20 of the upper 18. The expansion strip mating member 42 comprises an expansion strip zipper chain 44 which extends along an entirety of the distal edge 30 of the expansion strip 28. The upper zipper chain 40 forms a water-impermeable seal with the outsole zipper chain 36 when coupled thereto, and the expansion strip zipper chain 44 forms a water-impermeable seal with the outsole zipper chain 36 when coupled thereto.

An upper zipper slider 46 is slidably mounted to the upper zipper chain 40 and is slidably couplable to the outsole zipper chain 36. The upper zipper slider 46 is slidable along the upper zipper chain 40 and the outsole zipper chain 36 simultaneously to interlock the upper zipper chain 40 and the outsole zipper chain 36. An expansion strip zipper slider 48 is slidably mounted to the expansion strip zipper chain 44 and is slidably couplable to the outsole zipper chain 36. The expansion strip zipper slider 48 is slidable along the expansion strip zipper chain 44 and the outsole zipper chain 36 simultaneously to interlock the expansion strip zipper chain 44 and the outsole zipper chain 36. In other embodiments, a single slider may be slidably mounted to the outsole zipper chain 36 and may be slidably couplable alternately with the upper zipper chain 40 and the expansion strip zipper chain 44.

In some embodiments alternatives to a zipper may be used instead of or in addition to the zipper assembly described. For example, the outsole mating member 34 may comprise a row of male snap members, and the upper mating member 38 and the expansion strip mating member 42 may comprise rows of female snap members. Similarly, other connection types may be used, such as hook-and-loop fastening, button-and-hole fastening, magnetic fastening, or the like. In connection types where a mating member of a first type mates with a mating member of a second type that is distinct from the first type, the upper mating member 38 and the extension mating member have the same type while the outsole mating member 34 has the type which mates with that same type.

In use, either the bottom edge 20 of the upper 18 or the distal edge 30 of the expansion strip 28 is coupled closely to the top side 14 of the outsole 12 via the connector assembly as described more fully above. When the upper zipper chain 40 is interlocked with the outsole zipper chain 36, the expansion strip 28 may be folded or wadded and held within the space formed between the upper 18 and the outsole 12. The expansion strip zipper slider 48 is then surrounded by the expansion strip 28, the upper zipper chain 40, and the outsole zipper chain 36. More space is defined between the upper 18 and the outsole 12 when the expansion strip zipper chain 44 is connected to the outsole zipper chain 36 than when the upper zipper chain 40 is connected to the outsole zipper chain 36. The expandable shoe 10 may thus be especially useful for a user whose feet are growing, as the space between the upper 18 and the outsole 12 may be expanded as a thickness of each foot of the user's feet between a bottom of the foot and a top of the foot increases.

Figure 4:
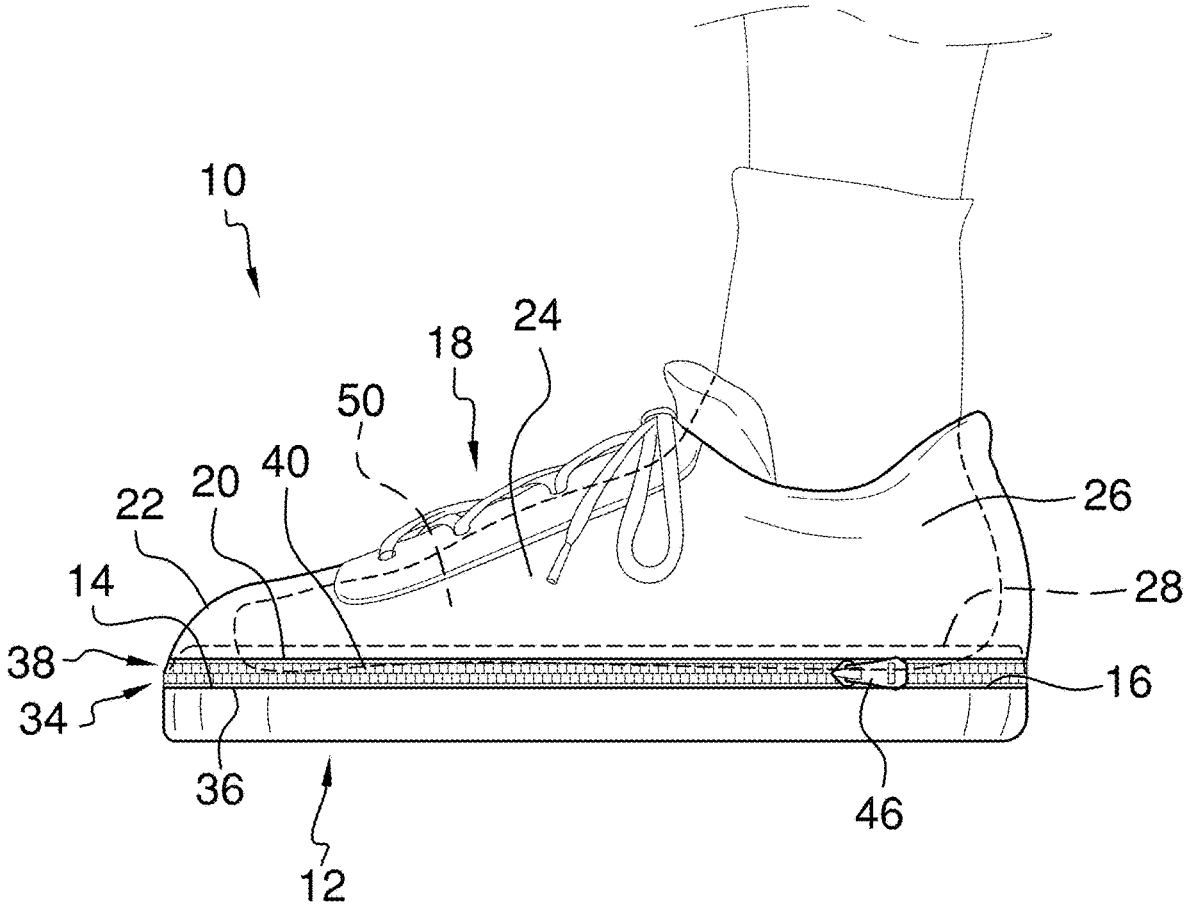
FIG. 4 is a side in-use view of an embodiment of the disclosure. An upper of the expandable shoe is joined directly to an outsole of the expandable shoe with an expansion strip positioned in a space formed between the upper and the outsole.

FIG. 4 depicts the expandable shoe 10 being worn on a small foot 50 which fits between the upper 18 and the outsole 12 when the upper 18 is coupled to the outsole 12 via the upper zipper chain 40. FIG. 1 depicts the expandable shoe 10 being worn on a large foot 52, that is a foot which is thicker than the small foot 50, which fits between the upper 18 and the outsole 12 when the expansion strip 28 is coupled to the outsole 12 via the expansion strip zipper chain 44. The small foot 50 and the large foot 52 may be the same foot at different stages of growth.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An expandable shoe comprising:

an outsole;

an upper which is removably couplable to a top side of the outsole at a bottom edge of the upper;

an expansion strip coupled to the bottom edge of the upper, the expansion strip being removably couplable to the top side of the outsole at a distal edge of the expansion strip with respect to the upper;

a connector assembly for alternately attaching the upper and the expansion strip to the outsole, the connector assembly comprising:

an outsole mating member mounted to the outsole;

an upper mating member mounted to the upper, the upper mating member being releasably couplable to the outsole mating member; and an expansion strip mating member mounted to the expansion strip, the expansion strip mating member being releasably couplable to the outsole mating member;

wherein the upper comprises a fabric material; and wherein the expansion strip comprises the fabric material, the expansion strip being integrally formed with the upper.

2. The expandable shoe of claim 1, wherein the outsole comprises a resilient material.

3. The expandable shoe of claim 1, wherein the upper comprises a toe box, a vamp, and a heel portion, the vamp being coupled to and extending between the toe box and the heel portion.

4. The expandable shoe of claim 1, wherein:

the outsole mating member comprises an outsole zipper chain;

the upper mating member comprises an upper zipper chain; and the expansion strip mating member comprises an expansion strip zipper chain.

5. The expandable shoe of claim 4, wherein:

a bottom edge of the upper forms a closed loop;

the expansion strip extends along an entirety of the bottom edge of the upper, the distal edge of the expansion strip with respect to the upper forming a closed loop;

the outsole zipper chain extends along an entirety of a peripheral edge of the top side of the outsole;

the upper zipper chain extends along the entirety of the bottom edge of the upper; and the expansion strip zipper chain extends along an entirety of the distal edge of the expansion strip.

6. The expandable shoe of claim 5, wherein:

the upper zipper chain forms a water-impermeable seal with the outsole zipper chain when coupled thereto; and the expansion strip zipper chain forms a water-impermeable seal with the outsole zipper chain when coupled thereto.

7. The expandable shoe of claim 4, wherein the connector assembly further comprises:

an upper zipper slider slidably mounted to the upper zipper chain and slidably couplable to the outsole zipper chain, the upper zipper slider being slidable along the upper zipper chain and the outsole zipper chain simultaneously to interlock the upper zipper chain and the outsole zipper chain; and an expansion strip zipper slider slidably mounted to the expansion strip zipper chain and slidably couplable to the outsole zipper chain, the expansion strip zipper slider being slidable along the expansion strip zipper chain and the outsole zipper chain simultaneously to interlock the expansion strip zipper chain and the outsole zipper chain.

8. The expandable shoe of claim 1, further comprising an insole which is positionable between the upper and the outsole when the outsole is coupled to the upper or the expansion strip.

9. An expandable shoe comprising:

an outsole, the outsole comprising a resilient material;

an upper which is removably couplable to a top side of the outsole at a bottom edge of the upper, the bottom edge of the upper forming a closed loop, the upper comprising a toe box, a vamp, and a heel portion, the vamp being coupled to and extending between the toe box and the heel portion, the upper comprising a fabric material;

an expansion strip coupled to the bottom edge of the upper, the expansion strip being removably couplable to the top side of the outsole at a distal edge of the expansion strip with respect to the upper, the expansion strip extending along an entirety of the bottom edge of the upper, the distal edge of the expansion strip with respect to the upper forming a closed loop, the expansion strip comprising the fabric material, the expansion strip being integrally formed with the upper;

a connector assembly for alternately attaching the upper and the expansion strip to the outsole, the connector assembly comprising:

an outsole mating member mounted to the outsole, the outsole mating member comprising an outsole zipper chain, the outsole zipper chain extending along an entirety of a peripheral edge of the top side of the outsole;

an upper mating member mounted to the upper, the upper mating member being releasably couplable to the outsole mating member, the upper mating member comprising an upper zipper chain, the upper zipper chain extending along the entirety of the bottom edge of the upper, the upper zipper chain forming a water-impermeable seal with the outsole zipper chain when coupled thereto;

an upper zipper slider slidably mounted to the upper zipper chain and slidably couplable to the outsole zipper chain, the upper zipper slider being slidable along the upper zipper chain and the outsole zipper chain simultaneously to interlock the upper zipper chain and the outsole zipper chain;

an expansion strip mating member mounted to the expansion strip, the expansion strip mating member being releasably couplable to the outsole mating member, the expansion strip mating member comprising an expansion strip zipper chain, the expansion strip zipper chain extending along an entirety of the distal edge of the expansion strip, the expansion strip zipper chain forming a water-impermeable seal with the outsole zipper chain when coupled thereto; and an expansion strip zipper slider slidably mounted to the expansion strip zipper chain and slidably couplable to the outsole zipper chain, the expansion strip zipper slider being slidable along the expansion strip zipper chain and the outsole zipper chain simultaneously to interlock the expansion strip zipper chain and the outsole zipper chain; and an insole which is positionable between the upper and the outsole when the outsole is coupled to the upper or the expansion strip.

* * * * *